US008936158B2

(12) United States Patent
Salow et al.

(10) Patent No.: US 8,936,158 B2
(45) Date of Patent: Jan. 20, 2015

(54) PRODUCT PACKAGING WITH SLIDE OUT TRAY

(75) Inventors: Ryan Salow, Minneapolis, MN (US); Tricia Genett, Minneapolis, MN (US); Megan O'Neil, Minneapolis, MN (US); Brad Webb, Woodbury, MN (US); Keri Wiesner, Edina, MN (US); Mark Weimholt, Coon Rapids, MN (US)

(73) Assignee: BBY Solutions, Inc., Richfield, MN (US)

( * ) Notice: Subject to any disclaimer, the term of this patent is extended or adjusted under 35 U.S.C. 154(b) by 401 days.

(21) Appl. No.: 13/349,032

(22) Filed: Jan. 12, 2012

(65) Prior Publication Data

US 2012/0318704 A1 Dec. 20, 2012

Related U.S. Application Data

(60) Provisional application No. 61/498,045, filed on Jun. 17, 2011.

(51) Int. Cl.
*B65D 5/50* (2006.01)
*B65D 77/04* (2006.01)

(52) U.S. Cl.
CPC ..... *B65D 77/0433* (2013.01); *Y10S 206/806* (2013.01)
USPC ..... 206/758; 206/769; 206/806

(58) Field of Classification Search
CPC .. B65D 43/12; B65D 43/0214; B65D 5/4208; B65D 73/0064; A45C 11/00
USPC ..... 206/806, 535, 538, 736, 751, 758, 769, 206/771, 774; 220/351, 345.1, 345.2
See application file for complete search history.

(56) References Cited

U.S. PATENT DOCUMENTS

| | | | | |
|---|---|---|---|---|
| 2,313,376 | A * | 3/1943 | Ullman | 206/766 |
| 2,534,100 | A * | 12/1950 | Baumgartner | 220/345.4 |
| 3,833,143 | A * | 9/1974 | Starkermann et al. | 220/351 |
| 4,284,204 | A * | 8/1981 | Carey, Jr. | 220/345.3 |
| 4,702,369 | A * | 10/1987 | Philosophe | 206/312 |
| 4,817,819 | A * | 4/1989 | Kelly | 221/2 |
| 6,321,944 | B1 * | 11/2001 | Cetrangolo | 222/105 |
| 6,523,691 | B2 * | 2/2003 | Raj et al. | 206/538 |
| 7,281,630 | B2 | 10/2007 | Hartman | |

(Continued)

FOREIGN PATENT DOCUMENTS

JP 2002284149 10/2002

OTHER PUBLICATIONS

Feb. 27, 2013 PCT Search Report (Serial No. PCT/US12/42642)—Our Matter 4877.

(Continued)

*Primary Examiner* — Jacob K Ackun
(74) *Attorney, Agent, or Firm* — Beck & Tysver PLLC

(57) ABSTRACT

A product package is presented that has a sliding tray disposed within a sleeve. Both the sleeve and the tray have a tab on their top portions through which is positioned a hang-hole. The hang-holes in these two tabs align when the tray is inserted into the sleeve, allowing a display hanger to pass through the hole in both tabs. The tray also has a structure with an overhang portion that extends beyond a side wall of the tray. The overhang portion is positioned to abut the edge of the sleeve when the tray is fully inserted into the sleeve to prevent the tray from passing too far into, or even through the sleeve.

17 Claims, 3 Drawing Sheets

(56) References Cited

U.S. PATENT DOCUMENTS

| | | | | |
|---|---|---|---|---|
| D614,022 | S | 4/2010 | Melnick | |
| D625,185 | S | 10/2010 | Clark | |
| D625,598 | S | 10/2010 | Ruth | |
| D646,985 | S | 10/2011 | Roesier | |
| 8,235,204 | B2 * | 8/2012 | Loughman et al. | 206/1.5 |
| 2004/0108372 | A1 | 6/2004 | Porcano | |
| 2006/0289336 | A1 | 12/2006 | Ford | |
| 2007/0045154 | A1 * | 3/2007 | Gelardi et al. | 206/736 |
| 2007/0181458 | A1 * | 8/2007 | Ehrlund | 206/528 |
| 2007/0251983 | A1 | 11/2007 | Freeze | |
| 2008/0197043 | A1 * | 8/2008 | Freeze et al. | 206/538 |
| 2010/0101972 | A1 * | 4/2010 | Clarke | 206/531 |
| 2010/0236944 | A1 * | 9/2010 | Dehlin | 206/1.5 |
| 2010/0294692 | A1 * | 11/2010 | Gelardi | 206/468 |
| 2011/0132797 | A1 * | 6/2011 | Adair et al. | 206/558 |
| 2014/0097122 | A1 * | 4/2014 | Patterson et al. | 206/758 |

OTHER PUBLICATIONS

Alibaba Full Box Package for Iphone 3g with Accessories. Downloaded from the Internet on Feb. 6, 2013 at http://www.alibaba.com/product-gs/359840463/Full_box_package_for_iphone_3g.html.

* cited by examiner

PRODUCT PACKAGING WITH SLIDE OUT TRAY

CROSS REFERENCE TO RELATED APPLICATION

This application claims the benefit of U.S. Provisional Application No. 61/498,045, filed Jun. 17, 2011, which is hereby incorporated by reference in its entirety.

FIELD OF INVENTION

The present invention relates to the field of product packaging. More particularly, the invention relates to package having a partially transparent sleeve and an interior slide-out tray having a pull-tab with an overhanging element.

SUMMARY

One embodiment of the present invention provides a two-part packaging with a sliding tray that is disposed within a sleeve. The tray has a recessed cavity formed in its front face into which a product can be placed. The sleeve has a partially transparent body, allowing a consumer to look through the sleeve and see the product positioned within the sliding tray.

Both the sleeve and the tray have a tab on their top portions through which is positioned a hang-hole. The hang-holes in these two tabs align when the tray is inserted into the sleeve, allowing a display hanger to pass through the hole in both tabs. This prevents gravity from pulling the tray out from the sleeve when the packaging is hanging at a retail location.

The tray also has a second tab that is used to pull the tray out from the sleeve. This pull-handle tab extends from the top of the tray, and has an overhang portion that extends beyond the side wall of the tray. The overhang portion of the pull-handle tab is positioned to abut the edge of the sleeve when the tray is fully inserted into the sleeve. This prevents the tray from passing too far into, or even through the sleeve.

In one embodiment, the sleeve has a rectangular cross section, while the front wall of the tray has a curved, convex shape. When the tray is inserted into the sleeve, the front wall of the sleeve will assume the same convex shape of the tray. The opening in the front face of the tray preferably has a sloped upper portion to help ensure that the sleeve does not catch on the top of the opening when the tray is inserted into the sleeve.

DETAILED DESCRIPTION OF THE INVENTION

Figure 1:
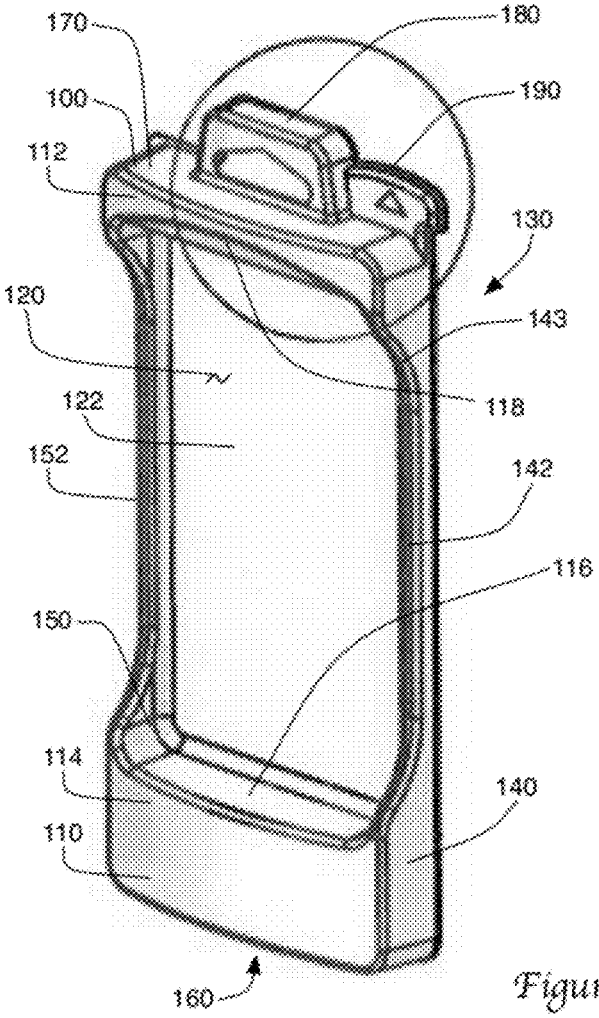
FIG. 1 is a perspective view of one embodiment of a tray used in the present invention.

FIG. 1 shows one embodiment of a sliding tray 100 that could be used in a sliding tray and sleeve combination package. The sliding tray has a front face 110 that is divided into a top portion 112 and a bottom portion 114. Between these two portions 112, 114 lies an interior space 120 within the tray 100. A right side wall 140, a left side wall 150, a bottom wall 160, and a top wall 170 complete the primary walls of the tray 100.

In one embodiment, the tray 100 is manufactured through a plastic thermoforming process. In this process, plastic is heated and placed over an aluminum mold that has been machined to be either a positive or negative version of tray 100. The plastic is molded into shape by positive or negative air pressure, then cooled. In such an embodiment, the rear edge portions of walls 140, 150, 160, 170 of tray 100 form a rear plane 130, and the various raised features of tray 100 are contoured according to the shape of the original aluminum mold. Other known manufacturing processes, such as injection, blow, or rotational molding could also be used to create tray 100.

In a preferred embodiment, right and left side walls 140, 150 are generally flat, extending at approximately right angles from the generally flat rear plane 130. The front face 110 preferably has a curved, convex shape that extends away from the rear plane 130 near the center of the tray 100.

Figure 2:
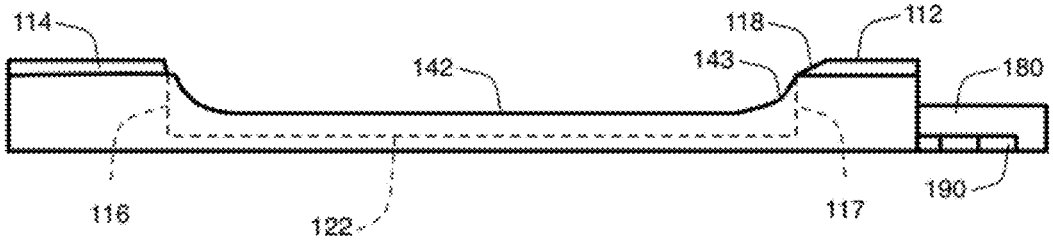
FIG. 2 is a right side elevation view of the tray of FIG. 1.

The interior space 120 is designed to hold a product (not shown). The rear wall 122 of the interior space 120 may be located at the rear plane 130 of the tray 100, or slightly in front of rear plane 130. The bottom wall 116 and top wall 117 of the interior space 120 (see FIG. 2) join the rear wall 122 to the bottom portion 114 and top portion 112 of the front face 110, respectively. The side walls 140, 150 of the tray 100 form the side walls of the interior space 120. These side walls 140, 150 have formed sections 142, 152 that allow the product located in the interior space 120 to be visible whether a potential consumer views the product directly from the front face 110, or from the sides through the cut-away sections 142, 152 in the side walls 140, 150.

The tray 100 is designed to be placed within a relatively tight-fitting sleeve 300, which is described below in connection with FIG. 3. Tray 100 is designed to slide into sleeve 300 and remain in place with a friction fit. As a result, there is a risk that a portion of the sleeve 300 will catch on the top wall 117 of the interior space 120 when the tray 100 is inserted into the sleeve 300. To prevent the sleeve from getting caught on top wall 117, the side cut-away sections 142, 152 are designed to slope smoothly back toward the top portion 112 of the front face 110 without any sharp corners or bends. This is seen most clearly at slope 142 shown in FIG. 2. Similarly, the top wall 117 is designed to include a ramp 118 nearest the top portion 112 of the front face 110, which when combined with the convex shape of the front face 110 causes the top portion 112 to be thinner in the middle than toward the side walls 140, 150. This ramp 118 in the top wall 117 also serves to prevent the sleeve 300 from catching on the tray 100 during insertion.

Figure 3:
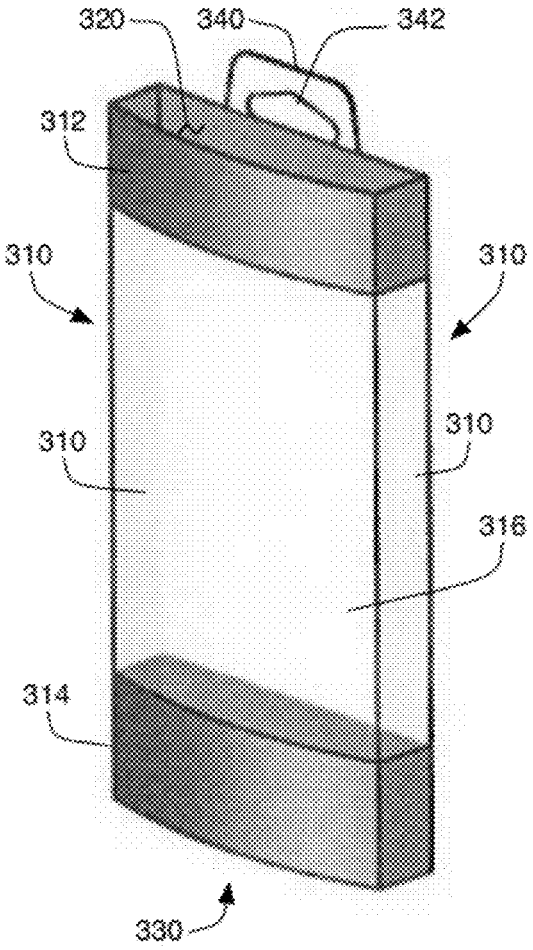
FIG. 3 is a perspective view of one embodiment of a sleeve used in the present invention.

FIG. 3 shows the sleeve 300 that is to be used with the tray 100 to create a package for the display of a product. The sleeve has a generally rectangular cross-section formed by four side walls 310. The front and rear side walls 310 are wider than the right and left side walls 310. Each wall is sized in accordance with the respective walls 110, 130, 140, 150 of the tray 100 so as to accommodate the tray 100 inside the sleeve 300. In one embodiment, each of the side walls 310 has a printed or otherwise opaque top portion 312 and bottom portion 314, and a transparent center portion 316. The transparent center portion 316 allows a consumer to see into the interior space 120 of the tray 100 to see the product located there, while the top and bottom portions 312, 314 allow printed content to be placed on the sleeve 300 without interfering with such a view. The top 320 of the sleeve 300 is left open, as the tray 100 is specifically designed to be inserted into the top 320 of sleeve 300. The bottom 330 may also be left open to save money in the manufacture of the sleeve 300.

Figure 4:
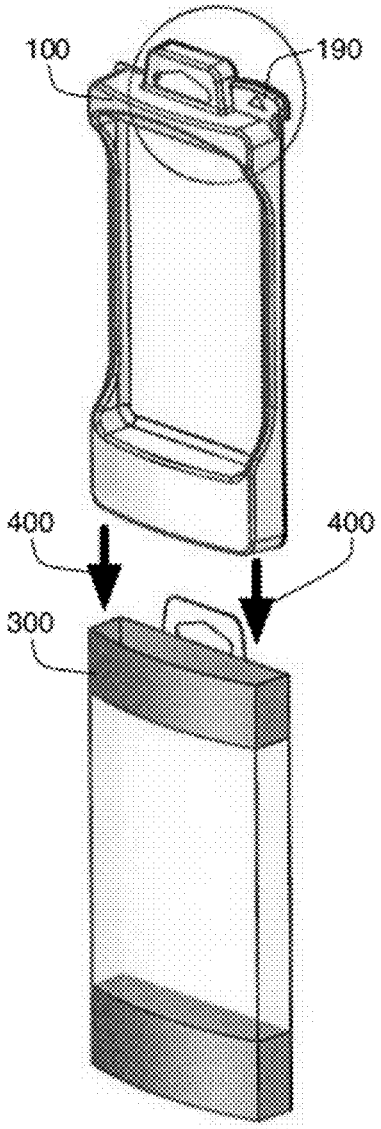
FIG. 4 is a perspective view of the tray of FIG. 1 being inserted into the sleeve of FIG. 3.

FIG. 4 shows the tray 100 of FIG. 1 being inserted into the sleeve 300 of FIG. 3. The arrows 400 show the direction in which the tray 100 is inserted. As explained above, the sleeve 300 has a generally rectangular cross-section, and therefore is slightly deformed by the insertion of the tray 100 that has a concave front face 110. This deformation, coupled with the appropriate sizing of the sleeve side walls 310, allows the creation of a friction fit between the tray 100 and the sleeve 300. The fit is tight enough to prevent the tray 100 from moving freely within the sleeve 300, but not so tight as to prevent a user from removing the tray 100 from the sleeve 300.

On the top wall 170 of the tray resides a hang-hole tab 180 and a pull-handle tab 190. These two elements 180, 190 are shown in more detail in FIG. 2. Through the hang-hole tab 180 is a hang-hole 182 through which a hook can be placed to hang the product packaging in a retail location. In the embodiment shown in FIGS. 1 and 2, the hang-hole 182 has an extended shape with a middle portion extending further toward the top edge of the hang-hole tab 180 tray than the edge portions of the hang-hole 182. This shape causes a smaller hook to rest naturally at this middle, top portion of the hang-hole 182 when the product is hung at the retail location. Larger hooks can also be accommodated, up to the width of the hang-hole 182.

The pull-handle tab 190 is shown on the right side of the tray 100, although it could easily be located on the left side. Alternatively, the tab 190 could be located on both the left and right sides of the tray. The purpose of the pull-handle tab 190 is to allow a consumer a convenient handle to pull the tray out of the sleeve 300 after purchasing the product. An indicator 192 (in this case a simple triangle) on the pull-handle tab 190 shows the consumer the direction that the consumer should pull to remove the tray 100 from the sleeve. The pull-handle 190 also has an overhang portion 194 that extends rightward beyond the right wall 140 of the tray (the overhang portion 194 would extend leftward beyond the left wall 150 of the tray if the tab 190 were located on the left side of tray 100). This overhang portion 194 is designed to engage the top of the sleeve 300 to prevent the tray 100 from sliding too far into (or even through) the sleeve 300, as is described below in connection with FIG. 6.

Located on the top of the rear side wall 310 of the sleeve is a sleeve hang-hole tab 340. Like the hang-hole tab 180 of the tray, the sleeve hang-hole tab 340 has a sleeve hang-hole 342 designed to receive a hook during the retail display of the product.

Figure 5:
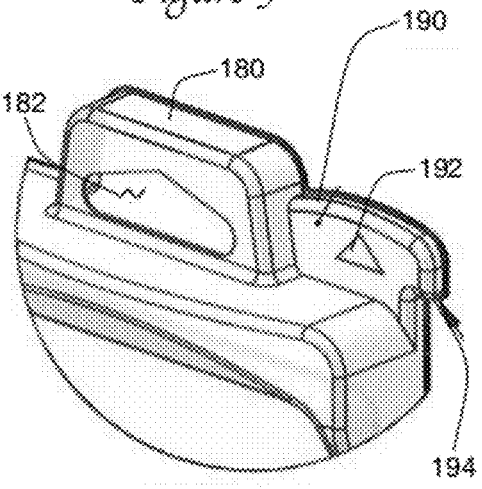
FIG. 5 is a detailed, perspective view of the top right corner of the tray of FIG. 1.
Figure 6:
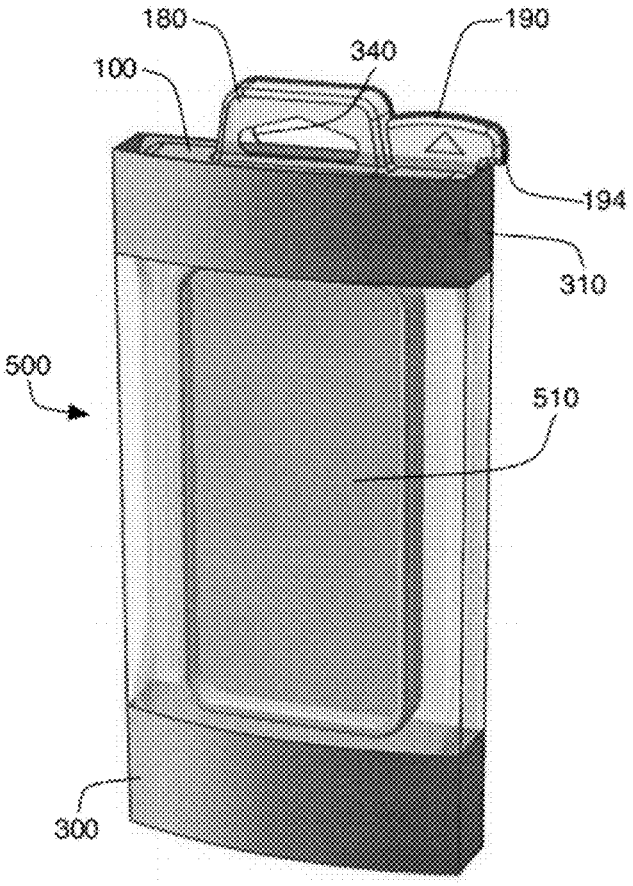
FIG. 6 is a perspective view of the tray and sleeve combination package.

FIG. 6 shows the entire packaging 500 consisting of the tray 100 inside the sleeve 300. The packaging 500 is shown with a product 510 located within the interior space 120 of the tray 100 and visible through the transparent portions 316 of the side walls 310 of the sleeve 300. As shown in FIG. 5, the overhang 194 of the pull-handle tab 190 abuts the top of the right side wall 310 of the sleeve 300. This engagement prevents the tray 100 from sliding too far into the sleeve 300 when the package 500 is assembled. The engagement also ensures that the tray 100 is positioned at a known location with respect to the sleeve 300. This is especially important in lining up the sleeve hang-hole tab 340 with the hang-hole tab 180 of the tray 100, or more importantly the sleeve hang-hole 342 of the sleeve 300 with the hang-hole 182 of the tray 100. In this way a hook in a retail display can easily pass through both hang-holes 182, 342 simultaneously. By passing through hang-holes 182, 342 in both components 100, 300 of the package 500, this design is superior to designs where the product is hung from only one of the components 100, 300 in that the pull of gravity cannot pull the components 100, 300 apart. To ensure that the package 500 hangs straight, the hang-holes 182, 342 are positioned directly above the center of gravity of the entire package 500 including the product 510.

Figure 7:
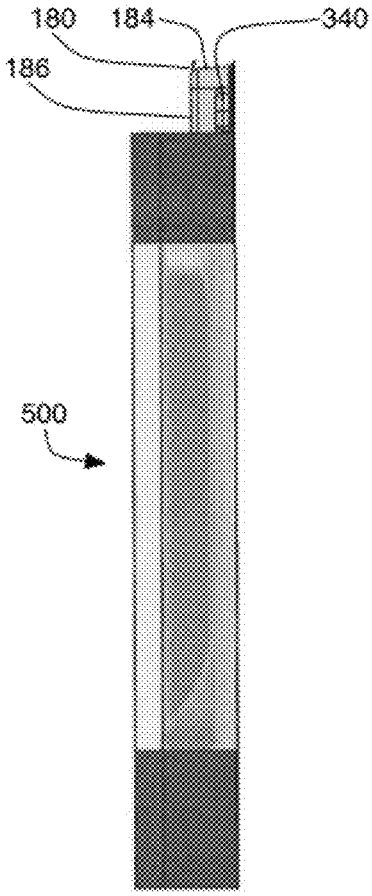
FIG. 7 is a right plan view of the tray and sleeve combination package of FIG. 5.

FIG. 7 shows the package 500 from the right side. This view shows that the hang-hole tab 180 of the tray 100 can be designed in one embodiment to effectively surround the sleeve hang-hole tab 340 of the sleeve 300. To accomplish this, the hang-hole tab 180 is designed with larger dimensions than the sleeve hang-hole tab 340. In addition, the hang-hole tab 180 has side walls 184 that extend backwards from a front face 186 of the tab 180. The side walls 184 preferably extend all the way to the rear plane 130 of the tray 100.

The many features and advantages of the invention are apparent from the above description. Numerous modifications and variations will readily occur to those skilled in the art. For instance, the pull-handle tab 190 and the hang-hole tab 180 of the tray 100 are shown and described above as separate tabs on the tray 100. It is well within the scope of the present invention to combine the hang hole of tab 180 and the overhang 194 of tab 190 onto a single structure on the top of tray 100. Since such modifications are possible, the invention is not to be limited to the exact construction and operation illustrated and described. Rather, the present invention should be limited only by the following claims.

What is claimed is:

1. A package for the display of a product comprising:

a) a sleeve having an open bottom and an open top;

b) a tray sized to be inserted into the sleeve through the top of the sleeve and to engage the sleeve with a friction fit;

c) a first tab located at a top portion of the tray, the first tab having an overhang, the overhang abutting the top of the sleeve when the tray is fully inserted into the sleeve;

d) a second tab located at the top portion of the tray, the second tab having a tray hang-hole; and e) a third tab located at the top of the sleeve, the third tab having a sleeve hang-hole;

wherein the tray hang-hole and the sleeve hang-hole align when the overhang of the first tab abuts the top of the sleeve.

2. The package of claim 1, wherein the first tab and the second tab are part of a single structure attached to the top portion of the tray.

3. The package of claim 1, wherein the sleeve has four side walls forming a rectangular cross section, and further wherein the tray has a convex front face that distorts the sleeve when the tray is inserted into the sleeve thereby enhancing the friction fit.

4. A package for displaying a product comprising:

a) a sleeve having a bottom and a top, wherein the top of the sleeve is open;

b) a tray for holding the product having i) a bottom side wall, a left side wall, a right side wall, and a top side wall, ii) a front face, and a rear surface formed by rear edges of the four side walls, iii) a length dimension running approximately parallel to the rear surface from the bottom side wall to the top side wall, iv) a depth dimension running approximately parallel to the rear side wall from the front face to the rear surface, v) a width dimension running approximately parallel to the top side wall from the left side wall to the right side wall, and vi) a pull-handle tab on the top side wall of the tray, the pull-handle tab extending away from the top side wall parallel to the length dimension of the tray and having a width parallel to the width dimension of the tray, wherein the pull-handle tab has a pull-handle depth parallel to the depth dimension of the tray, further wherein the pull-handle depth is less than the depth dimension of the tray, further wherein the pull-handle tab has an overhang wherein the overhang abuts the top of the sleeve when the tray is fully inserted into the sleeve.

5. The package of claim 4, wherein the tray is sized relative to the sleeve to cause the top of the sleeve to be even with the top side wall of the tray and the bottom of the sleeve to be even with the bottom side wall of the tray when the overhang of the pull-handle tab abuts the top of the sleeve.

6. The package of claim 4, wherein the tray further comprises:

vii) a second pull-handle tab having a second overhang located on the top side wall of the tray, wherein the second overhang abuts the top of the sleeve opposite the first pull-handle tab overhang when the tray is fully inserted into the sleeve.

7. The package of claim 4, wherein the bottom of the sleeve is open.

8. A package for the display of a product comprising:

a) a sleeve having:

i) a bottom and a top, wherein the top of the sleeve is open, ii) a sleeve hang-hole tab having a sleeve hang-hole located at the top of the sleeve, b) a tray having:

i) a bottom portion and a top portion, ii) a perimeter sized to be inserted into the sleeve through the top of the sleeve and to engage the sleeve with a friction fit;

iii) a tray hang-hole tab having a tray hang-hole located at the top portion of the tray, wherein the tray hang-hole and the sleeve hang-hole align when the tray is fully inserted into the sleeve.

9. The package of claim 8, wherein the dimensions of the tray hang-hole and the sleeve hang-hole are identical.

10. The package of claim 8, wherein the top of the sleeve is aligned to be even with the top of the tray and the bottom of the sleeve is aligned to be even with the bottom of the tray when the tray hang-hole and the sleeve hang-hole align.

11. The package of claim 8, wherein the tray hang-hole tab has larger dimensions than the sleeve hang-hole tab, and the sleeve hang-hole tab is surrounded by the tray hang-hole tab when the tray hang-hole and the sleeve hang-hole align.

12. A package for the display of a product comprising:

a) a sleeve having:

i) side walls extending from a bottom of the sleeve to a top of the sleeve, wherein the top of the sleeve is open, and ii) a sleeve hang-hole tab fixedly attached to at least one side wall of the sleeve at the top of the sleeve, the sleeve hang-hole tab having a sleeve hang-hole; and b) a tray having:

i) a bottom portion and a top portion, and sized to be inserted into the sleeve through the top of the sleeve and to engage the sleeve with a friction fit, ii) a pull-handle tab located at the top portion of the tray, the pull-handle tab having an overhang, and iii) a tray hang-hole tab located to the top portion of the tray, the hang-hole tab having a tray hang-hole;

wherein the tray hang-hole and the sleeve hang-hole align when the tray is fully inserted into the sleeve.

13. The package of claim 12, wherein the pull-handle tab overhang abuts the top portion of at least one side wall of the sleeve when the tray hang-hole and the sleeve hang-hole align.

14. The package of claim 12, wherein the pull-handle tab and the first hang-hole tab overlap to comprise a single structure.

15. A package for the display of a product comprising:

a) a sleeve having four side walls extending from a bottom of the sleeve to a top of the sleeve, wherein the top of the sleeve is open;

b) a tray sized to be inserted into the sleeve through the top of the sleeve and to engage the sleeve with a friction fit, the tray comprising:

i) a top and bottom, ii) a convex front face with a bottom face portion adjacent the bottom of the tray and a top face portion adjacent to the top of the tray, iii) a bottom interior wall, a top interior wall, and a rear interior wall defining an interior space between the bottom face portion and the top face portion, wherein the top interior wall further comprises a ramp adjacent the top face portion, the ramp sloping toward the top of the tray as it extends away from the rear interior wall.

16. The package of claim 15, further comprising a right side wall and a left side wall, each side wall having a first width adjacent the bottom and top face portions, a second width adjacent the interior space, and a curved slope connecting the second width with the first width adjacent the top face portion.

17. A package for the display of a product comprising:

a) a sleeve having four side walls extending from a bottom of the sleeve to a top of the sleeve, wherein the top of the sleeve is open;

b) a tray sized to be inserted into the sleeve through the top of the sleeve and to engage the sleeve with a friction fit, the tray comprising:

i) a top and bottom, ii) a convex front face with a bottom face portion adjacent the bottom of the tray and a top face portion adjacent to the top of the tray, iii) a bottom interior wall, a top interior wall, and a rear interior wall defining an interior space between the bottom face portion and the top face portion, and iv) a right side wall and a left side wall, each side wall having a first width adjacent the bottom and top face portions, a second width adjacent the interior space, and a curved slope connecting the second width with the first width adjacent the top face portion.

* * * * *